US006535184B1

(12) United States Patent
Yoon et al.

(10) Patent No.: US 6,535,184 B1
(45) Date of Patent: Mar. 18, 2003

(54) DYNAMIC DRIVING VACUUM FLUORESCENT DISPLAY

(75) Inventors: Bong-Eun Yoon, Ulsan (KR); Sung-Je Cho, Ulsan (KR)

(73) Assignee: Samsung SDI Co., Ltd., Suwon (KR)

( * ) Notice: Subject to any disclaimer, the term of this patent is extended or adjusted under 35 U.S.C. 154(b) by 168 days.

(21) Appl. No.: 09/710,433

(22) Filed: Nov. 10, 2000

(30) Foreign Application Priority Data

Nov. 10, 1999 (KR) ..... 1999-49693
Sep. 15, 2000 (KR) ..... 2000-54162

(51) Int. Cl.[7] ..... G09G 3/06

(52) U.S. Cl. ..... 345/47; 345/65; 345/75.1; 313/496; 313/497; 315/169.1; 315/169.3

(58) Field of Search ..... 345/47, 60, 65, 345/74.1, 75.2, 76, 79, 80; 315/169.1, 169.4, 169.3; 313/495, 496, 497

(56) References Cited

U.S. PATENT DOCUMENTS 4,633,134 A * 12/1986 Kishino et al. ..... 313/497
4,801,850 A * 1/1989 Kazan ..... 313/169.3
5,643,034 A * 7/1997 Mohri et al. ..... 445/24
6,392,356 B1 * 5/2002 Stevens ..... 315/169.3
6,400,073 B1 * 6/2002 Mihira et al. ..... 313/495

* cited by examiner

*Primary Examiner*—Bipin Shalwala
*Assistant Examiner*—Mansour M. Said
(74) *Attorney, Agent, or Firm*—Christie, Parker & Hale, LLP

(57) ABSTRACT

A dynamic driving vacuum fluorescent display (VFD) preventing erroneous activation of a phosphor layer by leakage electrons and allowing a simpler wiring structure is disclosed. The VFD has a substrate; a plurality of anodes formed on the substrate, phosphor layers formed on the respective anodes; cathodes located above the phosphor layers to generate electrons which strike the phosphor layers; and conductive ribs formed of an electrically conductive material on the substrate so as to surround at least a portion of a periphery of each of the phosphor layers and having a predetermined height. Each of the conductive ribs not only accelerates the electrons when a positive voltage is applied, but also cuts off the electrons from activation of the phosphor layers when a negative or zero cut-off voltage is applied.

12 Claims, 3 Drawing Sheets

DYNAMIC DRIVING VACUUM FLUORESCENT DISPLAY

BACKGROUND OF THE INVENTION (a) Field of the Invention

The present invention relates to vacuum fluorescent displays (VFDs), and more particularly, to dynamic driving VFDs preventing erroneous activation of a phosphor layer by leakage electrons, and allowing a simpler wiring structure.

(b) Description of the Related Art

In recent years, VFDs, utilizing phosphor display elements to form a viewed alphanumeric or graphic image, have come into wide use as displays in electronic and electrical appliances.

A typical vacuum fluorescent display device comprises a transparent evacuated envelope containing a plurality of anodes arranged in a pattern of desired light emission, each anode being coated with a phosphor layer for emitting light when excited, a heated filament serving as a source of electrons, and mesh grids located between the filament and the anodes for determining which anodes can be excited by the electrons. When the anodes and the mesh grids are at a high voltage and the filament is at a lower voltage the electrons can excite the phosphor layer on the anodes to cause light emission from the anodes.

Referring to FIG. 1, a conventional VFD will be described. An evacuated envelope is sealed with a face glass 102, a base substrate 104 and side glasses 106. A wiring layer 108 is deposited on the base substrate 104 and covered with an insulating layer 110 except at through-holes. A conducting layer 114 (anode) is formed on the insulating layer 110 and provided with a positive potential through the through-holes. A phosphor layer 112 is deposited on the conducting layer 114.

A plurality of filamentary cathodes 116 is located in the envelope space with the anode 114, and is heated to thermionically emit electrons. A mesh grid 118 is located between the anode 114 and the cathodes 116 to accelerate the emitted electrons.

In the VFD shown in FIG. 1, or other similar triode vacuum tubes, the filament is heated, such as by an AC current, to a temperature at which it will emit electrons. The mesh grid biased at a positive voltage accelerates electrons emitted from the filament toward the anode, which is also biased higher than the filament bias. On the anode, the phosphor layer emits light in response to the bombardment of electrons emitted from the filament and accelerated by the mesh grid to the anode.

There are two types of driving types for the VFD, namely a dynamic driving type and a static driving type. In the static driving type VFDs, the anode acts to selectively actuate the indication pattern. When the anode is provided with a lower potential than that applied to the cathodes, the corresponding phosphor does not emits light. The mesh grid merely accelerates electrons.

In dynamic driving type VFDs, the mesh grid acts with respect to each of the indicating patterns to selectively actuate the indicating patterns. When the mesh grid is provided with a negative cut-off bias voltage (that is, a lower potential than that applied to the cathodes), the corresponding phosphor does not emits light. The mesh grid not only accelerates electrons, but also cuts off electrons.

The conventional fluorescent display tube of FIG. 1 has some drawbacks. First, the mesh grid is expensive, so it causes the manufacturing cost of VFDs to be high. Second, since only those electrons that pass through a positive mesh grid can reach the anode, some electrons that do not pass are absorbed by the mesh grid. That is, since only some of the emitted electrons impinge on the phosphor layer for lighting, the efficiency of electron function is not optimal and this results in a degradation of the brightness of the display.

Further, when the mesh grid is hit by the electrons, they may be heated by additional currents and suffer thermal deformation. Even if the spaces between grids are partially shifted, stains or spots will result on the display pattern.

In order to overcome the above drawbacks, another type of VFD has been proposed, in which electrically insulating ribs are formed on the substrate so as to surround respective phosphor layers. Further, grid electrodes are formed on the upper end faces of the ribs so that the grid electrodes are spaced from the upper surfaces of the phosphor layers in the direction perpendicular to the plane of the substrate.

FIG. 2 depicts a VFD having a similar structure to that shown in FIG. 1, except for an electrically insulating rib and grid electrode formed thereon. Each anode 114 and phosphor layer 112 is surrounded by an electrically insulating rib 118' having a height of 100–150 $\mu$m. A grid electrode 118" is formed on the upper surface of the rib 118' and has a height of 10–15 $\mu$m.

The rib 118' and grid electrode 118" are generally formed by a thick-film printing process. The rib consists of a plurality of layers laminated by printing with an insulating paste. Each layer is printed in a thickness of 10–30 $\mu$m and then dried. The printing and drying processes are repeated about three to fifteen times in order to complete each rib.

However, the conventional fluorescent display tube of FIG. 2 also has some drawbacks. First, it takes a long processing time since the insulating rib is laminated to a height of up to 100–150 $\mu$m and the grid electrode is then formed on the rib.

Further, in dynamic driving, some of the electrons, which are emitted from the filament and accelerated by the grid electrode, may leak into the insulating layer 110. Specifically, the electrons leak between a rib whose grid electrode is applied by a positive potential and a rib whose grid electrode is applied by a negative cut-off bias voltage. The leakage electrons are then applied to the adjacent anode through the rib because the anode is biased with a positive voltage, and activate a phosphor layer (A in FIG. 2) below the electrode grid to which a negative cut-off bias voltage is applied. In this case, the phosphor layer which is not required to glow may glow due to the leakage electrons.

Further, since the grid electrode is formed on the upper surface of the rib, an intricate wiring structure is needed to apply a voltage to the grid electrode, resulting in complex manufacturing processes.

SUMMARY OF THE INVENTION

In view of the prior art described above, it is an object of the present invention to provide a dynamic driving vacuum fluorescent display capable of preventing erroneous activation of phosphor layers by leakage electrons.

It is another object of the present invention to provide a dynamic driving vacuum fluorescent display capable of allowing a simpler wiring structure.

To achieve these objects, as embodied and broadly described herein, the invention comprises a substrate;

a plurality of anodes formed on the substrate, and phosphor layers formed on the respective anodes;

cathodes located above the phosphor layers to generate electrons which strike the phosphor layers; and conductive ribs formed of an electrically conductive material on the substrate so as to surround at least a portion of a periphery of each of the phosphor layers and having a predetermined height.

Each of the conductive ribs not only accelerates the electrons when a positive voltage is applied, but also cuts off the electrons from the activation of the phosphor layers when a negative or zero cut-off voltage is applied.

The predetermined height of the conductive rib is more than 30 $\mu$m, more preferably 60 $\mu$m from a upper surface of the phosphor layer.

Both the foregoing general description and the following Detailed Description are exemplary and are intended to provide further explanation of the invention as claimed.

BRIEF DESCRIPTION OF THE DRAWINGS

The accompanying drawings provide a further understanding of the invention and, together with the Detailed Description, explain the principles of the invention. In the drawings.

DETAILED DESCRIPTION OF THE PREFERRED EMBODIMENTS

The present invention will be described in detail with reference to the accompanying drawings.

Figure 1:
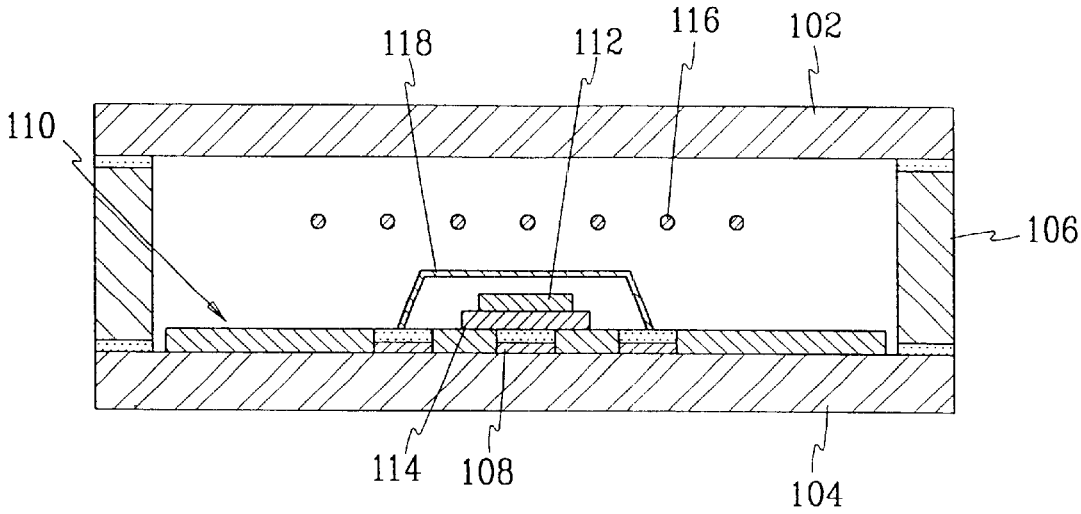
FIG.1 (Prior Art)
FIGS. 1 and 2 show a cross-section of a vacuum fluorescent display according to a prior art.
Figure 2:
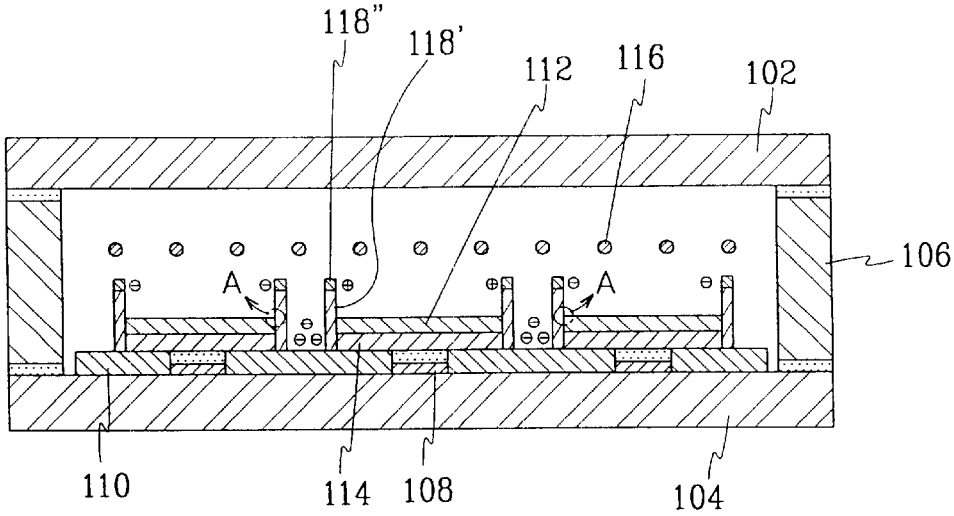
FIG.2 (Prior Art)
Figure 3:
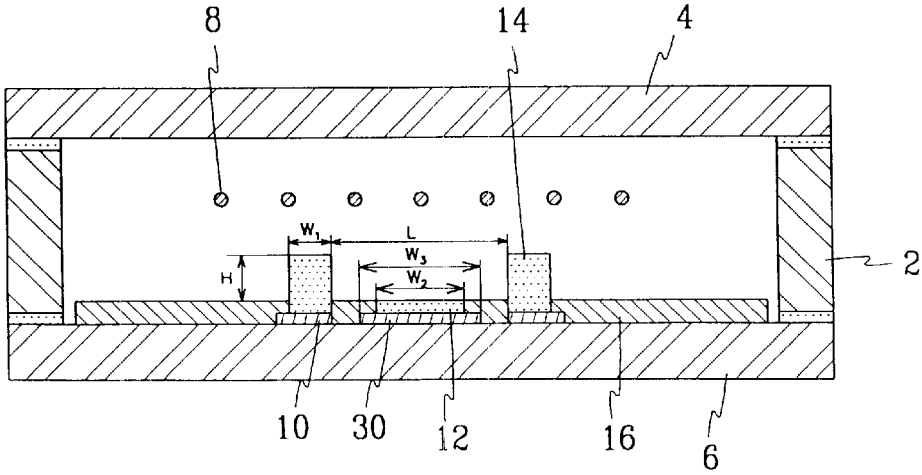
FIG. 3 shows a cross section of a vacuum fluorescent display according to the present invention.

Referring to FIG. 3, an evacuated envelope of a VFD according to the present invention is sealed with a face glass 4, a base substrate 6 and side glasses 2. The base substrate 6 comprises a wiring layer covered with an insulating layer 16. A wiring layer over which a phosphor layer 12 is covered is an anode 30. The anode 30 is provided with a positive potential.

The phosphor layer 12 is surrounded by an insulating layer 16 and electrically conductive ribs 14. The conductive ribs are formed directly on the wiring layer 10 without any complex wiring structure. The conductive ribs 14 are made of a conductive material such as silver (Ag), aluminum (Al) or carbon. The conductive ribs 14 are formed to a height of over 30 $\mu$m from the surface of the phosphor layer 12 by a thick film printing process. The wiring layer on which the ribs are printed is grid electrode 10, and each rib 13 has a wall thickness of about 25 $\mu$m.

A plurality of filamentary cathodes 8 (referred to as filaments hereinafter) are located in the envelope space with the anode 30 to emit electrons.

In the operation of the present dynamic driving VFD constructed as described above, the filament 8 is heated, such as by an AC current, to a temperature at which it will emit electrons. When a conductive rib 14 is biased at a positive potential, it accelerates electrons emitted from the filament 8 toward the anode. On the anode 30, the phosphor layer 12 emits light in response to the bombardment of electrons emitted from the filament 8 and accelerated by the conductive ribs 14. When a conductive rib 14 is biased at a negative or zero cut-off voltage, it repels the electrons so they do not impinge on the phosphor layer and light is not emitted.

The VFD according to the present invention prevents the leakage electrons in the insulating layer from activating the phosphor layer through the conductive rib 14 to which is applied a cut-off voltage, when the leakage electrons are between a conductive rib to which is applied a positive potential and the other conductive rib to which is applied a cut-off voltage. This results from the conductive rib 14 being biased at a negative (or zero) cut-off voltage, and this repels the leakage electrons.

There may be other types of electron leakage. That is, some of the electrons accelerated by the conductive ribs to which the accelerating voltage is applied may leak and strike some of the phosphor layers surrounded by the adjacent rib to which the negative cut-off bias voltage is applied. In this case, the phosphor layer, which is not required to glow, may glow due to the leakage electrons. To avoid such erroneous activation of the phosphor layers, the height of the conductive rib must be adjusted. The experimental results of the inventor of the present invention are shown in Table 1 below.

The experimental conditions are as follows:

The driving voltage $V_{PP}$ is set to 25 V, ⅕ duty cycles, the width W1 of the conductive rib is 200 $\mu$m, the width W2 of the phosphor layer is 300 $\mu$m, the width W3 of the anodes is 400 $\mu$m, and the space L between the ribs which surround the phosphor layer is 800 $\mu$m.

The relationship between the height of the rib and leakage is sought in the case where the above parameters remain constant.

TABLE 1

| Height H of Rib ($\mu$m) | Leak if Cut-off voltage is not applied | Cut-off voltage | Leak if cut-off voltage is applied |
|---|---|---|---|
| 30 | Leak | 6V | No leak |
| 40 | Leak | 5V | No leak |
| 50 | Leak | 4V | No leak |
| 60 | No leak | 0V | No leak |
| 70 | No leak | 0V | No leak |
| 80 | No leak | 0V | No leak |

Referring to Table 1, when the height of the rib is 30 $\mu$m and a voltage over the cut-off voltage of 6V is applied, then leakage electrons are not generated. When the height of the rib is 40 $\mu$m and a voltage over the cut-off voltage of 5V is applied, then leakage electrons are not generated. When the height of the rib is 50 $\mu$m and a voltage over the cut-off voltage of 4V is applied, then leakage electrons are not generated. When the height of the rib is more than 60 $\mu$m, leakage electrons are not generated even if a zero cut-off voltage is applied.

Therefore, the higher the conductive rib is, the lower the cut-off voltage needs to be. Specifically, the conductive rib having a height of more than 60 $\mu$m prevents electron leakage irrespective of cut-off voltage.

As explained above, a VFD according to the present invention employs conductive ribs which prevent leakage electrons from contributing to erroneous lighting. The present invention presents the appropriate height of the conductive rib and cut-off voltage applied thereto.

This arrangement is effective in preventing erroneous activation of the phosphor layers by leakage electrons through adjusting the height of the conductive rib and the cut-off voltage. This arrangement is also effective in allowing a simple wiring structure because the conductive ribs are formed directly on the wiring layer.

Figure 4A:
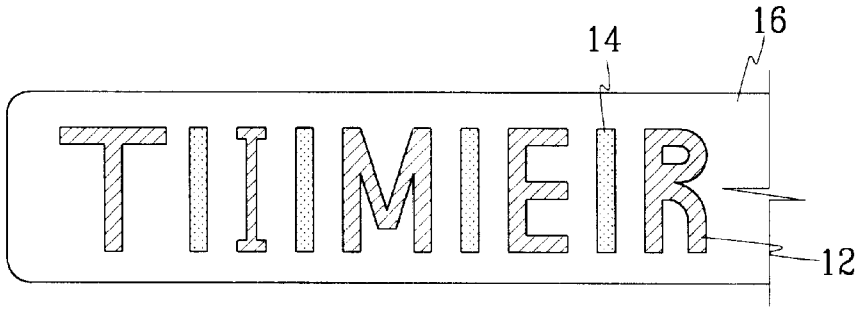
FIGS. 4*a*–4*c* show application examples of conductive ribs according to the present invention.
Figure 4B:
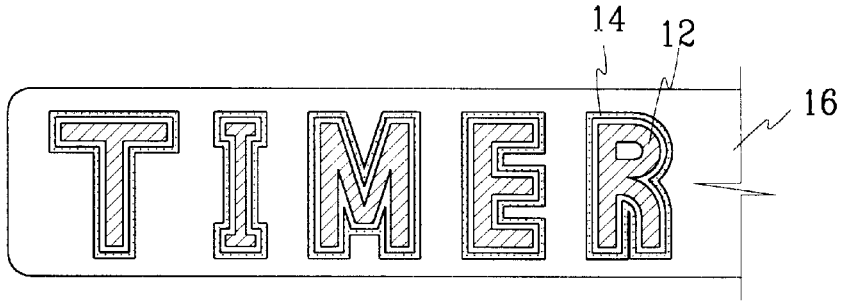
Figure 4C:
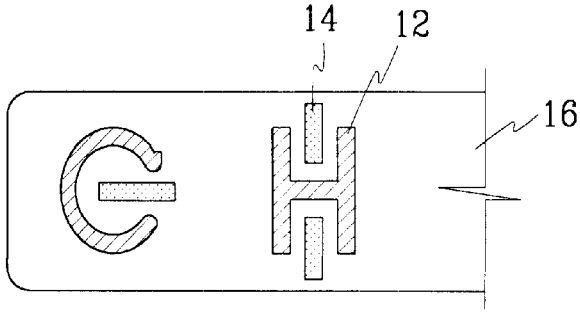

In applications, there are needs to display several characters or symbols such as "TIMER" or "Hi-Fi" which forms a segment. However, when one segment has a length over 1 cm, it is not sufficient to prevent electron leakage by encompassing the segment by means of conductive ribs. FIGS. 4*a*–4*c* illustrate conductive ribs where one segment has long length.

Conductive ribs 14 may be provided between the characters which form one segment as shown in FIG. 4*a*, or may encompass each character as shown in FIG. 4*b*. As shown in FIG. 4*c*, conductive ribs 14 are provided between spaces in the character. Therefore, the arrangement of FIGS. 4*a*–4*c* prevent electron leakage regardless of any segment length.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A dynamic driving vacuum fluorescent display comprising: a substrate;

wiring layers formed on the substrate, for performing electrical connection in the display;

phosphor layers connected to the wiring layers for emitting fluorescence filaments located above the phosphor layers to generate electrons which strike the phosphor layers; and conductive ribs formed of an electrically conductive material on the substrate so as to surround at least a portion of a periphery of each of the phosphor layers and having a predetermined height, wherein each of the conductive ribs not only accelerates the electrons when a positive voltage is applied, but also cuts off the electrons from activating the phosphor layers when the conductive ribs are biased at a negative or zero voltage.

2. The dynamic driving vacuum fluorescent display as recited in claim 1, wherein the phosphor layers are formed directly on the wiring layers.

3. The dynamic driving vacuum fluorescent display as recited in claim 1, wherein the conductive ribs are formed directly on wiring layers which supplies appropriate potential.

4. The dynamic driving vacuum fluorescent display as recited in claim 1, wherein the conductive ribs are provided between characters, the characters forming a segment.

5. The dynamic driving vacuum fluorescent display as recited in claim 1, wherein the conductive ribs are provided to encompass each of characters, the characters forming a segment.

6. The dynamic driving vacuum fluorescent display as recited in claim 1, wherein the conductive ribs are provided in spaces of characters, the characters forming a segment.

7. The dynamic driving vacuum fluorescent display as recited in claim 1, wherein the predetermined height of the conductive rib is more than 30 $\mu$m from an upper surface of the phosphor layer.

8. The dynamic driving vacuum fluorescent display as recited in claim 7, wherein a cut-off voltage is more than 6 V when the conductive rib has a width of 200 $\mu$m, the phosphor layer has a width of 300 $\mu$m, the anode has a width of 400 $\mu$m, the space between the conductive ribs which surround the phosphor layer is about 800 $\mu$m, the conductive rib has a height of 30 $\mu$m from a upper surface of the phosphor layer, and a driving voltage of the anode $V_{PP}$ is set to 25 V, ⅕ duty cycles.

9. The dynamic driving vacuum fluorescent display as recited in claim 7, wherein a cut-off voltage is more than 5 V when the conductive rib has a width of 200 $\mu$m, the phosphor layer has a width of 300 $\mu$m, the anode has a width of 400 $\mu$m, the space between the conductive ribs which surround the phosphor layer is about 800 $\mu$m, the conductive rib has a height of 40 $\mu$m from a upper surface of the phosphor layer, and a driving voltage of the anode $V_{PP}$ is set to 25 V, ⅕ duty cycles.

10. The dynamic driving vacuum fluorescent display as recited in claim 7, wherein the predetermined height of the conductive rib is more than 60 $\mu$m from an upper surface of the phosphor layer.

11. The dynamic driving vacuum fluorescent display as recited in claim 1, wherein a cut-off voltage is more than 4 V when the conductive rib has a width of 200 $\mu$m, the phosphor layer has a width of 300 $\mu$m, the anode has a width of 400 $\mu$m, the space between the conductive ribs which surround the phosphor layer is about 800 $\mu$m, the conductive rib has a height of 50 $\mu$m from a upper surface of the phosphor layer, and a driving voltage of the anode $V_{PP}$ is set to 25 V, ⅕ duty cycles.

12. The dynamic driving vacuum fluorescent display as recited in claim 1, wherein a cut-off voltage is more than 0 V when the conductive rib has a width of 200 $\mu$m, the phosphor layer has a width of 300 $\mu$m, and the anode has a width of 400 $\mu$m, the space between the conductive ribs which surround the phosphor layer is about 800 $\mu$m, the conductive rib has a height of 60 $\mu$m or higher from a upper surface of the phosphor layer, and a driving voltage of the anode $V_{PP}$ is set to 25 V, ⅕ duty cycles.

* * * * *